United States Patent [19]

Graff

[11] Patent Number: 4,611,727

[45] Date of Patent: Sep. 16, 1986

[54] SOLID ORAL DOSAGE DISPENSER WITH SAFETY, TAMPER-PROOF AND SANITATION FEATURES

[76] Inventor: James C. Graff, 105 W. Queens Dr., Williamsburg, Va. 23185

[21] Appl. No.: 703,370

[22] Filed: Feb. 20, 1985

[51] Int. Cl.[4] ..... B65H 3/00

[52] U.S. Cl. ..... 221/154; 221/196; 221/246; 221/265; 206/540

[58] Field of Search ..... 221/265, 264, 263, 246, 221/196, 195, 194, 191, 154; 206/540, 528; 222/153, 370

[56] References Cited

U.S. PATENT DOCUMENTS

| | | | |
|---|---|---|---|
| 2,761,592 | 9/1956 | Lewis et al. | 222/370 |
| 3,102,662 | 9/1963 | Crabtree | 221/154 X |
| 3,730,387 | 5/1973 | McConnell et al. | 221/265 |
| 3,860,111 | 1/1975 | Thompson | 206/534 |
| 3,885,703 | 5/1975 | Neanvin | 221/202 |
| 3,889,847 | 6/1975 | Uroshevich et al. | 221/265 |
| 3,893,593 | 7/1975 | Hazard | 222/48 |
| 3,991,908 | 11/1976 | Thomas et al. | 221/154 |

FOREIGN PATENT DOCUMENTS

| | | | |
|---|---|---|---|
| 662597 | 5/1963 | Canada | 221/265 |

*Primary Examiner*—Joseph J. Rolla
*Assistant Examiner*—David H. Bollinger
*Attorney, Agent, or Firm*—Griffin, Branigan & Butler

[57] ABSTRACT

A tablet or capsule dispenser includes a neck member (12) for forming an entrance through which tablets or capsules to be dispensed must pass to get to laterally-positioned delivery compartments (28) downstream thereof. A baffle member (14) is affixed to the neck member for defining baffle openings (42) which are aligned with each of the delivery compartments (28). A one-way rotary carousel member (16), positioned between the stationary baffle member (14) and the delivery compartments (28), has a rotating opening (50) therein which, when aligned with the delivery compartments allows tablets or capsules therein to be dispensed. The rotating opening includes a radial wall (54) at a trailing edge of the rotating opening for contacting a tablet or capsule located in a delivery compartment to thereby prevent further rotation of the carousel member unless the tablet or capsule in the compartment is dispensed and an internal wall (52) at an internal edge of the rotating opening to isolate tablets and capsules at the delivery compartment from tablets and capsules passing through the delivery opening. The carousel member is rotated relative to the container and its neck portion by means of a transparent cap apparatus (18) which has male threads (74) for engaging female threads (76) on the carousel member (16) and which has floating safety female threads (66) for engaging male threads (32) on the outer surface of the container neck member.

14 Claims, 8 Drawing Figures

SOLID ORAL DOSAGE DISPENSER WITH SAFETY, TAMPER-PROOF AND SANITATION FEATURES

BACKGROUND OF THE INVENTION

This invention relates broadly to the art of tablet containers and dispensers and more specifically to dispensers for tablet containers which are tamper proof, sanitary and aid in separating desired dosage amounts.

In recent years a great deal of emphasis has been placed on tablet and capsule containers and caps and dispensers therefor from a number of different perspectives. That is, safety covers have been developed—in some cases mandated—to protect children, easy dispensing devices have been developed to make it easier for older people and those of lesser dexterity to dispense desired dosages from containers and containers and covers have been developed which are tamper-resistant and can therefore not be intentionally or unintentionally polluted by germs, poison or the like.

It is an object of this invention to provide a tablet or capsule container cap assembly which: is child-resistant, aids elderly and those of lesser dexterity in dispensing desired dosages, prevents one from reintroducing tablets or capsules into a container once they have been removed and prevents someone from reaching tablets or capsules in the container with a contaminating probe. One significant example of how tablets in a container are unintentionally contaminated is that when one shakes a number of tablets from the container, into his hand and then shoves some of the tablets back into the container, leaving only the number he desires to take, he has often unintentionally, reintroduced contaminated tablets into the container. It is an object of this invention to prevent such unintentional, as well as other, contamination of tablets in containers.

It is a further object of this invention to provide a tablet or capsule cap assembly which is relatively uncomplicated to construct and use, and is therefore not unduly expensive.

SUMMARY

According to principles of this invention, a tablet or capsule container cap assembly includes a neck member which defines an entrance opening through which tablets or capsules to be dispensed must pass and, downstream thereof, a delivery compartment positioned laterally of the entrance opening so that the tablets or capsules must move laterally to enter the delivery compartment. The compartment is bounded by radially positioned slats and is of such a size that only a specific number of tablets or capsules will fit in it. The invention also includes a stationary baffle member which is affixed to the neck member and is adjacent to the delivery compartment. The stationary baffle member defines an opening which is aligned with the delivery compartment. A carousel member is positioned between the radially extending slats and the stationary baffle member to normally prevent tablets or capsules from passing through the baffle opening, but having freedom of rotation relative to the container neck member in only one direction. The carousel member has a tablet-carrying surface which defines a rotating opening of such a size for rotating to a position aligned with the baffle opening to thereby allow a tablet or capsule in said delivery compartment to pass therethrough. The slats are separated from the tablet-carrying surface of the carousel by a distance which is less than the smallest dimension of a tablet or capsule to be dispensed and the carousel member includes a radial wall at a trailing edge of the rotating opening for contacting a tablet or capsule located in the delivery compartment to thereby prevent rotation of the rotary opening past the delivery department unless a tablet or capsule at the delivery compartment is dispensed. Further, the carousel member includes an internal wall at an internal edge of the rotating opening to isolate the tablets or capsules in the delivery compartment at the baffle opening from other tablets or capsules passing through the delivery opening. A means is included in the invention for rotating the carousel member relative to the neck and baffle member and in the preferred embodiment this is a cap having male threads which mesh with female threads in the carousel member. The cap also includes child-resistant floating female threads for meshing with external male threads on the outer surface of the neck portion. In the preferred embodiment, there are a plurality of delivery compartments and a plurality of dispensing openings in the baffle member.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
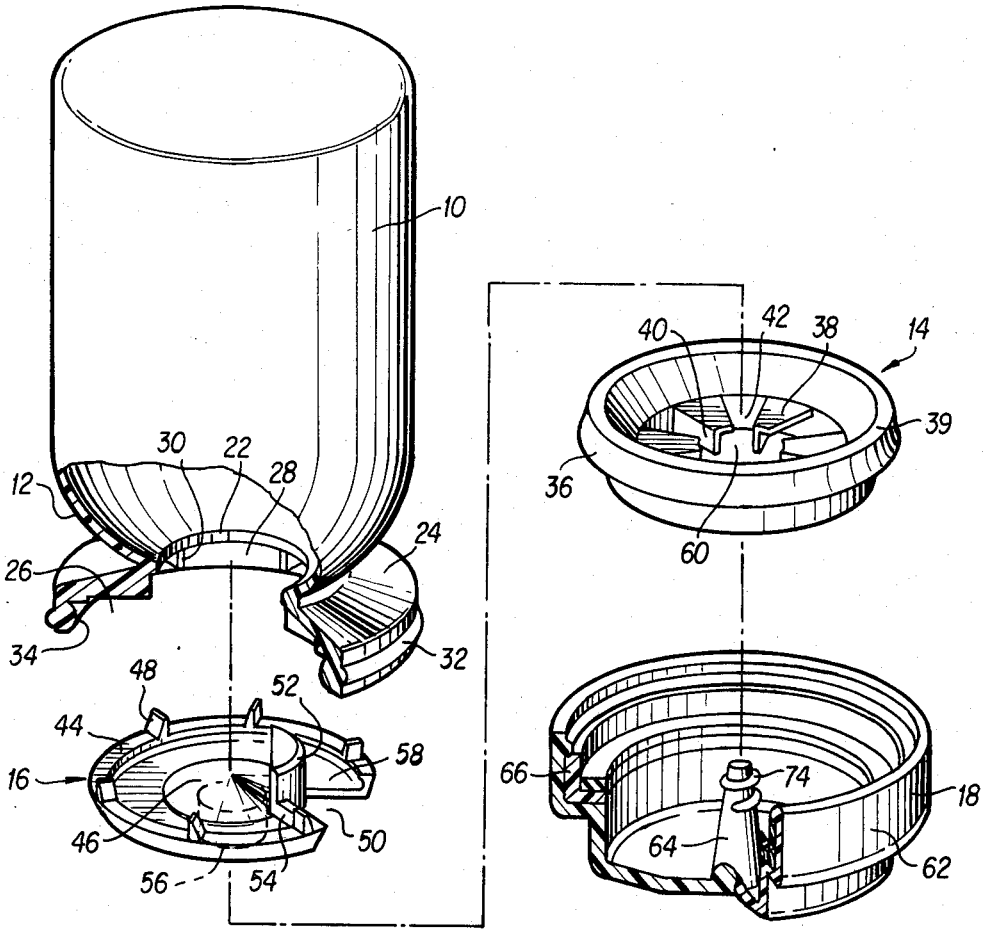
FIG. 1 is an exploded view of a container having the cap assembly of this invention thereon.

Referring to the drawings, and especially to FIG. 1, a tablet or capsule container 10 has at its mouth a cap assembly which includes a neck member 12, a stationary baffle member 14, a one-way rotary carousel member 16, and a transparent cap 18. For the sake of simplicity, during description of the invention tablets and capsules will be referred to as "tablets".

In the preferred embodiment, the neck member 12 is an integral part of the tablet or capsule container 10, however, it should be understood that the neck member 12 could be an add-on part to a separate container. The neck member 12 is constricted at 20 to form a delivery opening 22 through which tablets fall when the container 10 is turned upside-down as is shown in FIG. 1. Downstream thereof, the neck portion wall flares outwardly at 24 to form a cavity 26 which is positioned radially outwardly from the delivery opening 22. The cavity 26 is divided into a number of delivery compartments 28 (6 in the preferred embodiment) by radially positioned slats 30 which are integral with the neck member flared wall 24. Thus, tablets which enter the delivery compartments 28 pass downwardly through the delivery opening 22 and then laterally outwardly into the compartments 28. At the lower end of the neck member 12, on the outer surface thereof, are male threads 32 for engaging the cap 18 and on the inner surface thereof a mounting protrusion 34 on which the stationary baffle member 14 is mounted.

Figure 5:
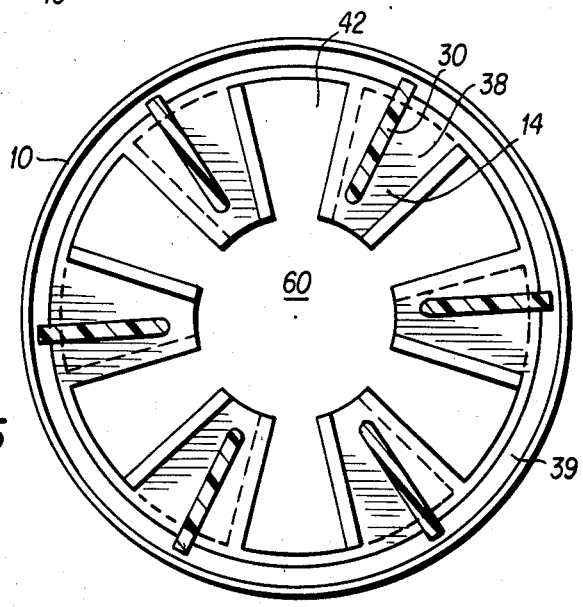
FIG. 5 is a simplified view showing the relative positions of a baffle member and slats in the invention of the previous drawings.

With regard to the stationary baffle member 14, this member has on its outer surface, an annular groove 36 for receiving the mounting protrusion 34 of the neck member 12 in a force-fit resilient manner so that the neck portion 12 and the stationary baffle member 14 do not move relative to one another. The stationary baffle member 14 includes horizontally-flat radial baffle elements 38 which extend radially inwardly from an annular frame 39 toward the center of the circularly shaped baffle member 14. Extending axially downwardly from one side of each of these baffle elements 38 is a blocking wall 40, the purpose of which will be described below. The baffle elements 38 define between them dispensing openings 42. As can be seen in FIG. 5, where slats 30 are depicted with baffle elements 38 with the carousel member 16 not being shown, the slats 30 are aligned with the baffle elements 38.

Figure 3:
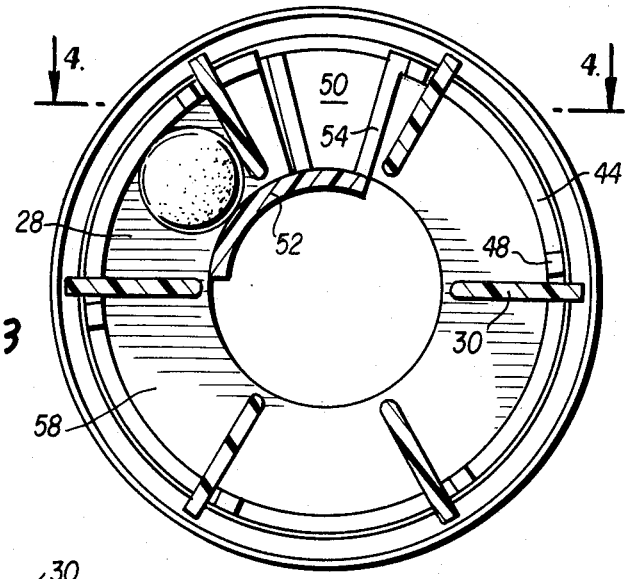
FIG. 3 is a simplified section taken on line 3—3 in FIG. 2, with container walls being left off for simplicity.

The carousel member 16 is positioned in the lower end of the neck member 12, between the stationary baffle member 14 and the slats 30. The carousel member 16 has a perimeter wall 44, a raised cone feed surface 46, ratchet teeth 48 mounted on the perimeter wall 44, a rotating opening 50, a curved internal wall 52, a shorter radial barrier wall 54, a hub 56 and a tablet-carrying surface 58. Basically, the carousel member 16 rides freely between the stationary baffle member 14 and the slats 30 with its hub 56 extending through a center opening 60 defined by the outer tips of the baffle elements 38 and with the ratchet teeth 48 thereof coming in light contact with the slats 30. The lower surface of a wall forming the tablet-carrying surface 58 rides on the top surfaces of the baffle elements 38. Thus, the carousel member 16 is free to rotate in its mounting in a counterclockwise direction as viewed in FIG. 3, but it cannot rotate further than the separation between two slats 30 in the clockwise direction relative to the tablet container 10.

Figure 2:
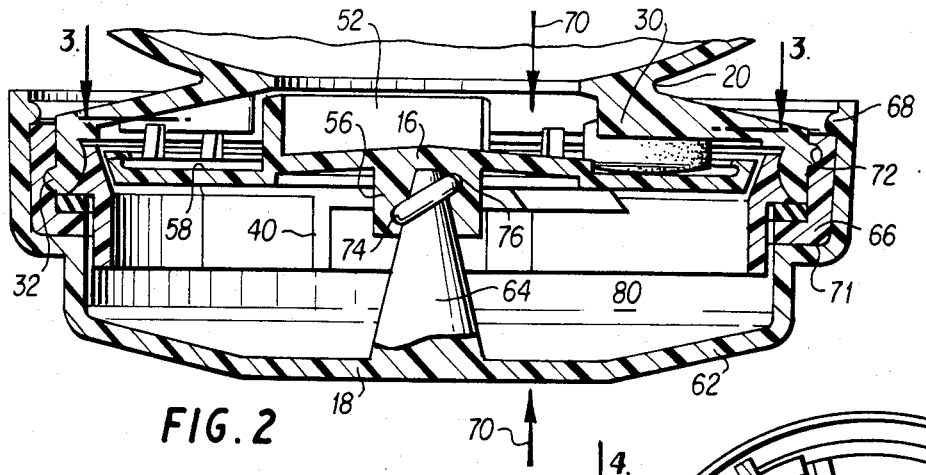
FIG. 2 is a side sectional view of the cap assembly of the device of FIG. 1.

The cap 18, as can best be seen in FIG. 2, comprises an outer shell 62 having an integral center-mounted rotating spindle 64 and carries a floating, safety, child-resistant, thread member 66. With regard to the floating thread member 66, this member is held onto the outer shell 62 by means of an annular protrusion 68 but is relatively free to rotate unless one presses the cap 18 and the container 10 together as at arrows 70. When one does this, the floating thread member 66 grips the outer shell 62 at interface 71 and rotates with the outer shell 62. The floating thread member 66 has female threads 72 which mesh with the male threads 32 on the neck member 12 of container 10. The rotating spindle 64 is cone-shaped and has male threads 74 which mesh somewhat loosely with female threads 76 in the hub 56 of the carousel member 16. When the outer shell 62 is rotated in a anti-clockwise direction, as viewed in FIG. 1, the male threads 74 seat firmly in the female threads 76 to rotate the carousel member 16 in an anti-clockwise direction relative to the tablet container 10; however, when the outer shell 62 is rotated in a counterclockwise direction, ratchet teeth 48 of the carousel member 16 engage slats 30 of the neck member 12 thereby preventing its further rotation and, upon further rotation of the outer shell 62, the male threads 74 of the rotating spindle 64 disengage from the female threads 76 of the carousel member hub 56 so that there is no substantial rotation of the carousel member in that direction. Both these rotations, as mentioned above, have no affect on engagement of the floating thread member 66 with male thread 32 of the bottle unless pressure is applied at arrows 70.

Describing the operation of this device, tablets, or capsules, are loaded into the container 10 through the delivery opening 22 at a factory with the carousel member 16 and the stationary baffle member 14 being removed; thereafter, the stationary baffle member 14 is machine-mounted on the mounting protrusion 34 of the container 10 in such a manner that it would be extremely difficult to remove without the application of tools and/or a great deal of force.

Figure 6:
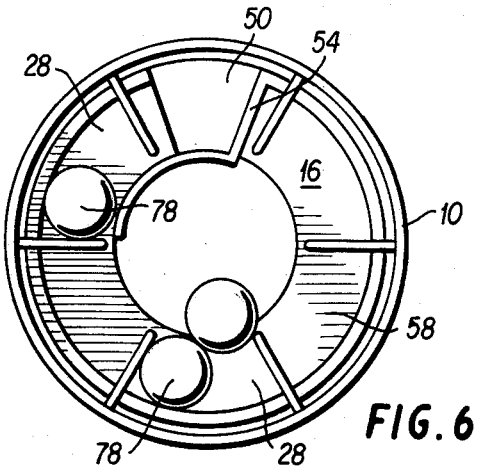
FIG. 6 is a sectional view similar to FIG. 3 but including tablets thereon to show the inner workings of the various members of the invention shown in the previous drawings.

In order to remove a single tablet or capsule from the container 10, the container is inverted and one holds the outer shell 62 of the cap 18 with one hand and rotates the bottle 10 in a clockwise direction with the other hand while gently pulling the cap 18 and bottle 10 apart (negative pressure at arrows 70). Thus, the spindle is relatively moved counterclockwise to the bottle by engagement of threads 74 and 76 of the spindle 64 and the hub 56. When the bottle 10 is inverted in this manner tablets fall downwardly through the delivery opening 22, strike the feed surface 46 of the carousel member 16 and move laterally into the delivery compartments 28 defined by the slats 30 and the outward flare 24 of the neck member wall. As can be seen in FIG. 6, only one tablet will fit into each delivery compartment 28. As the bottle 10 is rotated in the clockwise direction, each compartment is sequentially taken behind the internal wall 52 of the carousel member 16 to the rotating opening 50 of the carousel member 16. When the tablet 78 arrives at the rotating opening 50, it falls out of its delivery compartment 28 through the rotating opening 50 and through an aligned dispensing opening 42 of the stationary baffle member 14.

It will be appreciated that if, when a tablet or capsule arrives at the rotating opening 50, a person desires to, rather than remove the capsule, in some way pollute the capsule and then continue to rotate the container 10 so as to reintroduce the capsule into the container 10, this will not be possible because the tablet is caught between the radial wall 54 at the trailing edge of the rotating opening 50 and a slat 30. In this respect, the tablet in the delivery compartment 28 cannot get over the radial wall 54 because it is not allowed to rise by the outward flare wall 24 of the neck member 12. Also, the tablet cannot move radially inwardly because internal wall 52 blocks such movement. Thus, the person operating the container 10 must remove the tablet. Similarly, one cannot rotate the carousel member 16 in a clockwise direction relative to the container 10 (or rotate the container 10 in a counterclockwise direction relative to the carousel member 16), because the ratchet teeth 48 contacting the slats 30 prevent such movement. Also, upon such movement the threads of the spindle 64 disengage from internal threads 76 of the carousel hub 56 to not transmit such movement.

Figure 4:
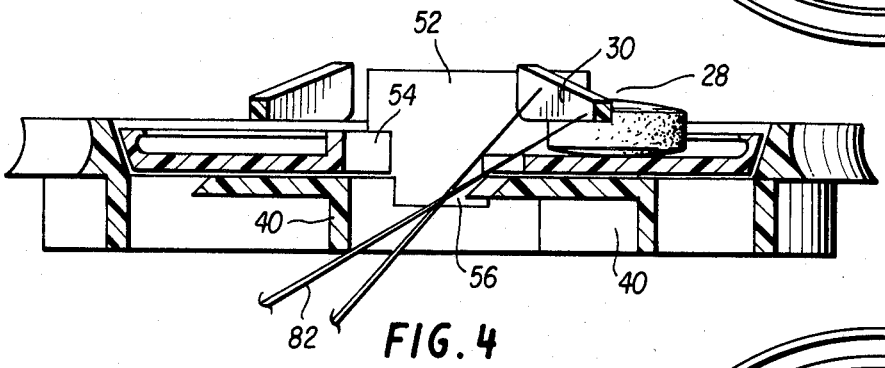
FIG. 4 is a sectional view taken on line 4—4 of FIG. 3 along with a hypodermic needle.

In any event, once a tablet has been dispensed from the delivery compartment 28 through the rotating opening 50 and the aligned dispensing opening 42, it falls in a cavity 80 of the cap 18. One continues to rotate the container 10 until he has collected the number of tablets or capsules he wishes to have in the cap 18 at which point, he presses the container 10 and the cap 18 together on force lines 70 to engage the floating thread member 66 and he rotates the container 10 in a counterclockwise direction, or rotates the cap 18 in a clockwise direction, to thereby unscrew the cap female threads 72 from the male bottle threads 32. Of course, the carousel member 16 does not follow such rotation as was previously described. The user now has the number of tablets or capsules he desires to use. These tablets or capsules, as has been previously pointed out, cannot be returned to the bottle and must be either used or thrown away. FIG. 4 illustrates that one can also not contaminate the tablets or capsules in the container 10 by means of a hypodermic needle 82 extended through a dispensing opening 42 and the rotating opening 50 to a delivery compartment 28 other than the compartment located at these two openings because of the blocking wall 40, the internal wall 52 and the radial wall 54 as well as the slats 30 preyent it. It can be seen in FIG. 4 that tablets not being dispensed cannot be reached by a hypodermic needle.

To screw the cap 18 on the container 10 the container 10 is returned to an upright position, the cap 18 and the container 10 are pushed together (positive pressure at arrows 70) and the cap is rotated in a clockwise direction (which corresponds to the counterclockwise direction when the bottle is inverted).

Figure 7:
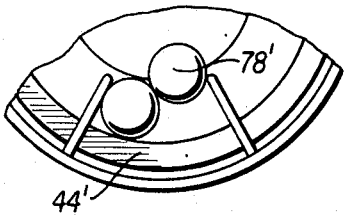
FIG. 7 is a segment view corresponding to the view of FIG. 6 showing a slightly modified embodiment of the invention.

FIG. 7 illustrates that the perimeter wall 44' of the carousel member 16 can be thickened to adapt the invention to smaller tablets 78'.

Figure 8:
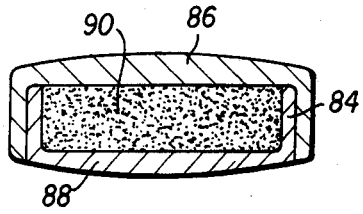
FIG. 8 is a side-sectional view of a capsule having a shape similar to that of a tablet.

FIG. 8 depicts a capsule 84 having mating sides 86 and 88 for holding a powdered medication 90 therein. The capsule 84 has the shape of a tablet so that it can be dispensed with the same device of this invention as is used for a tablet.

It will be appreciated by skilled in the art that the cap assembly of this invention provides not only a child-resistant cap, but also a contamination-free cap and an easily manipulative tablet dispenser for those with reduced hand dexterity.

While the invention has been particulary shown and described with reference to a preferred embodiment, it will be understood by those skilled in the art that various changes in form and detail may be made therein without departing from the spirit and scope of the invention. For example, the delivery compartments 28 could be angularly separated by a distance equal to the length of the internal wall 52 so that when one places the container 10 in an upright position to return the cap 18 to the container 10 none of the tablets will be trapped in a delivery compartment 28 behind the internal wall 52 and thereby inhibit rotation of the carousel member 16 in the clockwise direction when the cap 18 is screwed on. By giving the threads 74,76 a greater pitch than threads 72 the carousel member 16 need not rotate in any case in order to screw the cap 18 on.

The embodiments of the invention in which an exclusive property or privilege is claimed are defined as follows:

1. A tablet or capsule cap assembly for dispensing tablets or capsules from a container comprising:

a container neck having a passage wall defining an entrance opening through which tablets or capsules to be dispensed must pass in preparation for being dispensed from said container, said passage wall flaring outwardly downstream of said entrance opening to define a delivery compartment positioned laterally of said entrance opening so that said tablets or capsules must move laterally to enter said delivery compartment, said compartment being bounded by radially positioned slats, said delivery compartment being of such a size that only a specific number of tablets or capsules will fit therein;

a carousel member positioned adjacent said radially positioned slats to prevent tablets or capsules from passing from said delivery compartment, said carousel member having freedom of rotation relative to said container neck means in one direction, but not substantially in the other direction, said carousel member having a tablet-carrying surface with an opening therethrough of such a size and position for rotating to a position aligned with said delivery compartment and thereby allowing a tablet or capsule to pass from said delivery compartment through said rotating opening, the slats being separated from the tablet-carrying surface of said carousel member by a distance which is less than the smallest dimension of a tablet or capsule to be dispensed therewith and said carousel member including a radial wall at a trailing edge of said rotating opening for contacting a tablet or capsule located in said delivery compartment to thereby prevent further rotation of said carousel member unless a tablet or capsule is dispensed and an internal wall at an internal edge of said rotating opening to isolate said tablets or capsules at said delivery compartment from tablets or capsules passing through said entrance opening;

means for rotating said carousel member relative to said neck whereby once a container is inverted, a tablet or capsule enters said delivery compartment and said slats hold said tablet in said delivery compartment so that as said carousel member is rotated it slides along said tablet-carrying surface of said carousel member until said tablet or capsule falls through said carousel opening.

2. A tablet or capsule cap assembly as in claim 1 wherein said neck is round and has a plurality of slats defining a plurality of delivery compartments.

3. A tablet or capsule cap assembly as in claim 2 wherein said means for rotating said carousel member is a cap having a central spindle thereon for engaging said carousel member and further includes female threads for engaging male threads of the neck.

4. A tablet or capsule cap assembly as in claim 3 wherein said spindle includes threads which mesh with threads of said carousel member.

5. A tablet or capsule cap assembly as in claim 3 wherein the female threads of said cap which engage the male threads of said neck are child-proof threads which can rotate relative to the rest of said cap unless said cap is manipulated in a specific manner.

6. A tablet or capsule cap assembly as in claim 2 wherein is further included a stationary baffle member affixed to said passage wall adjacent said delivery compartments, said carousel member being positioned between said radially extending slats and said stationary baffle, said baffle member having a plurality of baffle openings each of which is aligned with one of said delivery compartments.

7. A tablet or capsule cap assembly as in claim 1 wherein is further included a stationary baffle member affixed to said passage wall adjacent said delivery compartment, said carousel member being positioned between said radially positioned slats and said stationary baffle, said baffle member having a baffle opening aligned with said delivery compartment.

8. A tablet or capsule cap assembly as in claim 7 wherein said stationary baffle includes an axially extending blocking wall adjacent said baffle opening to aid in blocking a probe extended at an angle through said opening.

9. A tablet or capsule cap assembly as in claim 1 wherein said means for rotating said carousel member is a cap having a central spindle thereon for engaging said carousel member and further includes female threads for engaging male threads of the neck.

10. A tablet or capsule cap assembly as in claim 9 wherein said spindle includes threads which mesh with threads of said carousel member.

11. A tablet or capsule cap assembly as in claim 5 wherein the female threads of said cap which engage the male threads of said neck member are child-proof threads which can rotate relative to the rest of said cap unless said cap is manipulated in a specific manner.

12. A tablet or capsule cap assembly as in claim 1 wherein a flat-shaped capsule having a shape similar to that of a tablet is dispensed therewith.

13. A tablet or capsule cap assembly as in claim 1 wherein said means for rotating said carousel member is a cap having a central spindle thereon for engaging said carousel member.

14. A tablet or capsule cap assembly as in claim 13 wherein said central spindle has threads thereon which mesh with threads on said carousel member to rotate said carousel member when said cap is rotated in said one direction but which unmesh from said threads when said cap is rotated in said other direction.

* * * * *